United States Patent [19]

Schimitzek et al.

[11] 4,419,846

[45] Dec. 13, 1983

[54] APPARATUS FOR GRINDING OPTICAL LENSES

[76] Inventors: Günter Schimitzek, An der Reute 8, 7923 Konigsbronn; Horst Reiche, Uhlandstr. 36, 7923 Konigsbronn/Zang, both of Fed. Rep. of Germany

[21] Appl. No.: 188,372

[22] Filed: Sep. 18, 1980

[30] Foreign Application Priority Data

Sep. 20, 1979 [DE] Fed. Rep. of Germany ..... 2937976

[51] Int. Cl.[3] ..... B24B 13/00

[52] U.S. Cl. ..... 51/55

[58] Field of Search ..... 51/55, 33 R, 284 R, 51/58, 105 EG, 105 LG, 106 LG, 124 L, 127, D15, 131.1, 134.5 R, 101 LG

[56] References Cited

U.S. PATENT DOCUMENTS

| | | | |
|---|---|---|---|
| 1,675,862 | 7/1928 | Paige | 51/124 L |
| 2,470,021 | 5/1949 | D'Avaucourt | 51/55 |
| 2,629,975 | 3/1953 | Desenberg | 51/55 |
| 2,977,724 | 4/1961 | Kennedy et al. | 51/55 |
| 3,117,396 | 1/1964 | Dalton | 51/33 R |
| 3,290,832 | 12/1966 | Highberg et al. | 51/134.5 R |
| 3,449,865 | 6/1969 | Suddarth | 51/55 |
| 3,534,506 | 10/1970 | Soong et al. | 51/55 |
| 3,877,177 | 4/1975 | Taniguchi | 51/55 |
| 3,889,426 | 6/1975 | Blum | 51/55 |
| 3,900,971 | 8/1975 | Bruek | 51/124 L |
| 4,180,946 | 1/1980 | Heijkenskjold et al. | 51/134.5 R |
| 4,216,626 | 8/1980 | Starp | 51/124 L |

*Primary Examiner*—Harold D. Whitehead
*Assistant Examiner*—Robert A. Rose

[57] ABSTRACT

Apparatus for producing convex and/or concave spherical surfaces such as optical lenses, comprising a workpiece spindle having an end face to which a workpiece to be machined is securable and a tool spindle carrying a tool for machining the workpiece, the two spindles being disposed at an angle to one another, and a mechanism for retaining the tool spindle in its angular position relative to the workpiece spindle including two mutually adjustable members, the first of said members being mounted so as to be pivotable about a primary axis which is tangential to the apex of the spherical surface to be produced and which axis is formed on a frame for the apparatus, the first member being adjustably locatable at a pre-selected angle of inclination commensurate with the radius of the spherical surface to be machined, the second of said members having the tool spindle directly mounted thereon and being mounted about a secondary axis on the first member such that the axes of mounting of the two members extend substantially parallel to one another but are spaced apart by a distance corresponding substantially to the longitudinal dimension of the first member, and the second member being pivotable about the secondary mounting axis and locatable at an angular position with respect to a line joining the two axes, such angular location being selected in dependence on the effective diameter of the machining tool.

16 Claims, 6 Drawing Figures

APPARATUS FOR GRINDING OPTICAL LENSES

BACKGROUND OF THE INVENTION

The present invention relates to an apparatus for producing convex and/or concave spherical surfaces, and more particularly to an apparatus for producing optical lenses, such as one in which the workpiece, e.g. lens, to be machined is retained on the end face of a rotating spindle having angularly associated therewith a tool spindle on which the operating or grinding tool such as a cup wheel, is retained, with the relative angular disposition of the spindles being adjustable.

Apparatus for machining optical lenses are known in which a swivel arm is used to hold the tool spindle. A slider member acting as the mounting for such tool spindle is mounted in the usual way in a sliding guide on the swivel arm so as to be transversely displaceable relative thereto. The slider member is actuatable by means of an actuating spindle. This permits the operating or grinding tool, that is to say, the diamond cup wheel or disc usually employed for grinding optical lenses, to be adjusted accurately, within technical limitations, so that its cutting lip lies exactly, subject to such limitations, on the pivotal axis of the swivel arm.

Apart from the technical difficulties in manufacturing such a transverse slide mechanism for hold the tool spindle, the known arrangements have a major disadvantage in that spindle holders utilizing conventional sliding guides have inherent tolerances which cannot be completely removed or eliminated. Experience has shown that it is almost impossible, utilizing such devices, to obtain accurately pre-machined ground surfaces, such a lenses, which are capable of being polished.

For this reason, especially when producing optical lenses having a spherical surface, it has hitherto been necessary to carry out several separate operations such as pregrinding and precision grinding on different machines. In other words, to produce an at least substantially spherical surface on a workpiece, the workpiece must first be roughly prepared. To level off any remaining deviations or inaccuracies in the roughly prepared spherical surface with respect to sphericality and to reduce the degree of roughness so as to render the spherical surface polishable, it has been necessary for the workpiece to be subjected to further intermediate surface treatment using an accurately radially fixed tool on a precision grinding machine. Only after this additional machining operation is it possible, in a still further operation on a polishing machine, for the workpiece to be completed.

Hence, for a workpiece to be provided with a spherical surface, a number of treatment stages beginning with the rough grinding of the blank and ending with polishing of the spherical surface, which has been precision ground in an intermediate operation, were heretofore necessary. The number of treatment stages itself obviously has an adverse effect on the cost of manufacture of workpieces having a spherical surface. Moreover, the cost of providing a number of different processing machines, particularly the cost for producing or obtaining the accurately radially fixed precision grinding tools must be taken into account since, without these, a polishing operation in known radial grinding machines is impractical from a time factor aspect.

It is among the objects and advantages of the present invention to overcome the above noted deficiencies and disadvantages of the prior art and to provide an apparatus for producing polishable spherical surfaces in workpieces such as optical lenses, in a single operation while avoiding the use of radially fixed tools.

It is among the additional objects and advantages of the present invention to provide an apparatus which is structurally sound, readily monitorable and simple to operate.

BRIEF DESCRIPTION OF THE DRAWINGS

Other and further objects and advantages of the present invention will become apparent from a study of the within specification and accompanying drawings, in which.

Figure 1:
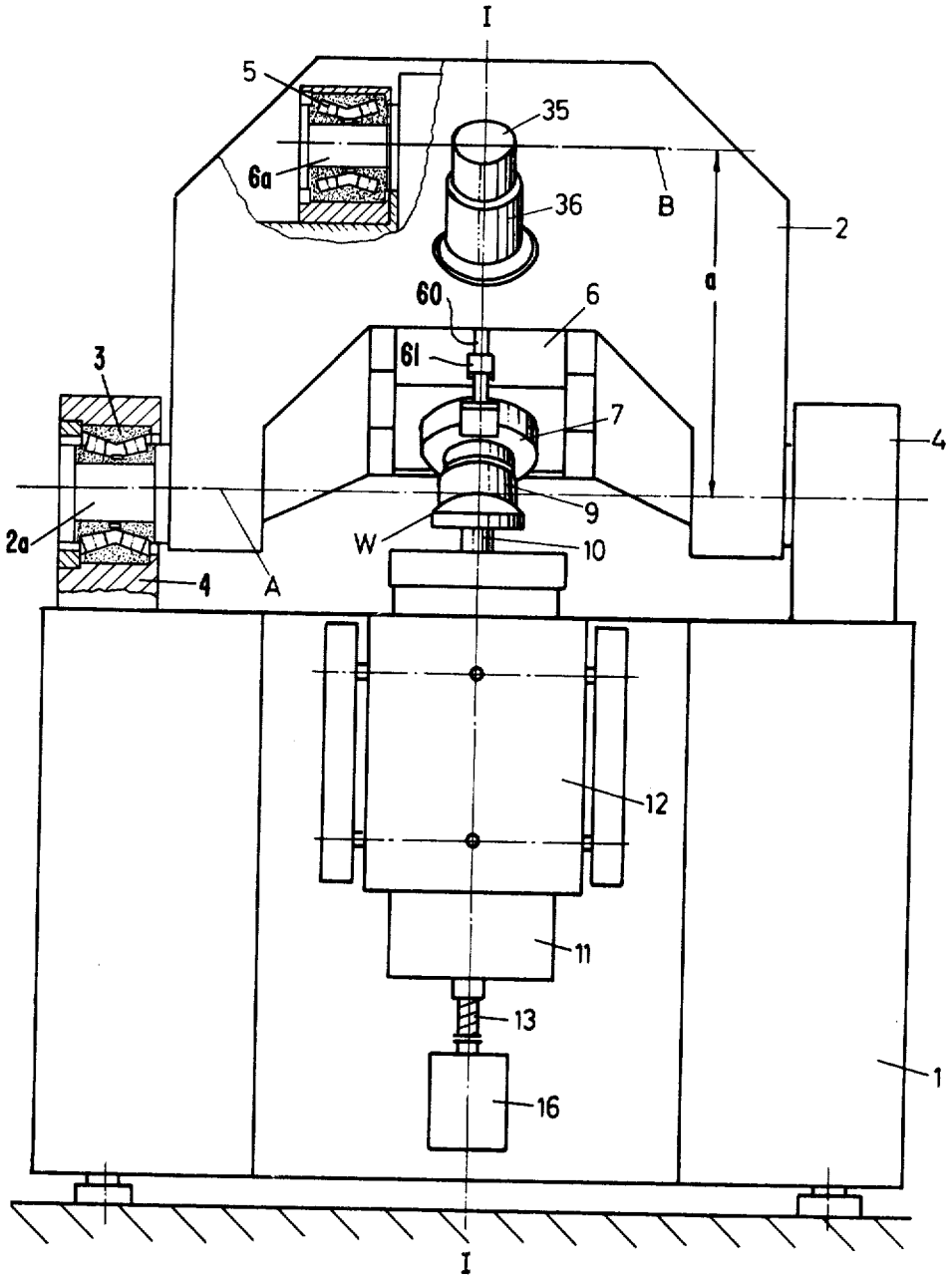
FIG. 1 shows a schematic front elevation of an apparatus according to an embodiment of the present invention for producing spherical surfaces.

In accordance with the present invention, an apparatus for producing convex and/or concave spherical surfaces such as optical lenses is provided. The apparatus comprises a workpiece spindle having an end face to which a workpiece to be machined is securable and a tool spindle carrying a tool for machining the workpiece, the two spindles being disposed at an angle to one another. Means are provided for retaining the tool spindle in its angular position relative to the workpiece spindle, including two mutually adjustable members.

The first of said members is mounted so as to be pivotable about a primary axis which is tangential to the apex of the spherical surface to be produced on the workpiece, the pivotal axis being formed on a frame for the apparatus. The first member is adjustably locatable at a pre-selected angle of inclination initially generally commensurate with the radius of the spherical surface to be machined.

The second of said members has the tool spindle directly mounted thereon and is itself mounted about a secondary axis on the first member, the primary and secondary axes of mounting of the two members extending substantially parallel to one another but being spaced apart by a distance corresponding substantially to the longitudinal dimension of the first member. The second member is pivotable about its secondary mounting axis and is locatable in an angular position with respect to a line joining the two axes, such angular location being selected in dependence on the effective diameter of the machining tool for final accurate angular alignment thereof with respect to the apex of the spherical surface to be produced.

Because the members retaining the tool spindle are mounted advantageously in journals substantially without any clearance, it is made possible by way of the present invention for spherical surfaces to be produced in a single operation including both preliminary grinding and precision grinding, which surfaces are of accurate sphericality and only have comparatively shallow depth of roughness. This means that the workpiece may be directly treated on a polishing machine as a finishing or final treatment.

Accordingly, not only is there a reduction in the time required to manufacture the desired lens surfaces, but also the special machinery necessary hitherto is no longer needed. As a result, according to the present invention, the manufacture of workpieces having a spherical surface, such as lenses, can be produced at lower cost and hence more economically.

Preferably, the first member is in the form of a swivel arm and the second member pivotally mounted thereof is in the form of a rocker arm, and a spindle sleeve receiving the tool spindle is axially displaceably mounted in the second member or rocker arm. This provides a location and guide system for the spindle sleeve or for the corresponding tool spindle which is substantially free from backlash or play and has an enhanced stability and rigidity compared with known sliding guides for tool spindles.

Desirably, the pivotal mounting of the rocker arm receiving the spindle sleeve is effected on the free end of the swivel arm, and the releasable locking of the rocker arm in selective adjustable angular position relative to the swivel arm is effected by known locking means at a location more or less adjacent the point at which the spindle sleeve leaves the rocker arm.

Advantageously, the angle of adjustment of the swivel arm with respect to its initial or reference position relative to the workpiece spindle is preferably indicated by a known optical and/or electronic device including a rotary angle transmitter. To attain final accurate positioning of the tool spindle and hence to provide conditions in which the machining of the workpieces is accurately reproducible, it is desirable to provide the spindle sleeve which is axially displaceably mounted in the rocker arm so as to be actuatable by known hydraulic, pneumatic or electromechanical means.

Further, preferably, an electro-hydraulic control device in conjunction with an opto-electronic odometric system and a device for indicating the distance moved may be provided in known manner for controlling the setting and adjustment movements of the axially adjustable spindle sleeve which receives the tool spindle.

A compact driving system for driving the tool spindle which obviates the need for transmission members may be achieved by providing that the tool spindle be driven by a high frequency motor having its stator and rotor portions housed within and preferably integral with the spindle sleeve and tool spindle elements respectively.

According to a further preferred feature of the present invention, the positions of the swivel arm and of the rocker arm may be made adjustable by means of a corresponding mechanically actuated adjustment member. Moreover, the swivel arm may be provided in the form of a gantry.

Referring to the drawings, an apparaus is shown comprising a basic frame 1 and a first member in the form of a swivel arm 2 which acts as a tool holder and is angularly displaceable relative to the frame 1. The arm 2 is preferably in the form of a gantry and is mounted on the frame 1 in supports 4 by means of link pins 2*a* and tapered roller bearings 3 so as to be pivotable about a substantially horizontal primary stationary proximate axis A. The supports 4 may be secured to the frame 1 by screw means or welding or the like.

The swivel arm 2 of course need not be in the form of a gantry and may even be made to have only one bearing, as the artisan will appreciate.

The arm 2 has the shape of a housing in which a corresponding second member in the form of a hollow rocker arm 6 is mounted by means of tapered roller bearings 5 and pins or pin like journals 6*a* so as to be angularly adjustable and locatable in position about a substantially horizontal secondary movable or floating distal axis B. The fixed distance mutual spacing a between the primary and secondary axes A and B corresponds substantially to the longitudinal dimension of the swivel arm 2. Axes A and B are substantially parallel.

A spindle sleeve 7 is axially guided in the hollow housing rocker arm 6, by appropriate telescoping arrangement of the pertinent parts, but prevented from twisting relative thereto, e.g. by suitable means such as corresponding tongue and groove or other cooperating interengaging means (not shown) as the artisan will appreciate, or by providing the resultant telescoping parts of oval rather than circular operative cross section. The spindle sleeve 7 is, in turn, hydraulically actuatable, for which purpose the housing for the spindle sleeve constituted by the rocker arm 6 has an annular space 6*c* defined in its interior by peripherally inwardly directed collar—or ring-like or annular shoulder portions 6*b*. The spindle sleeve 7 is slidably guided by these shoulder portions 6*b* and is itself provided with a peripherally outwardly directed shoulder 7*a* forming a ring piston or annular double acting piston.

Supply and discharge openings 6*d* and 6*e* lead into the ring chamber 6*c* at opposed end portion thereof an opposed sides of the ring piston 7*a* and are provided for the purpose of impacting the ring piston 7*a* with oil or other pressure fluid medium from a pair of alternating supply and discharge conduits, not shown in detail, which are correspondingly connected to the openings 6*d* and 6*e*, in dependence upon the desired direction of axial displacement of the spindle sleeve 7 in the manner of a double acting piston within the double acting cylinder as constituted by the rocker arm 6.

Although hydraulic actuation of the spindle sleeve 7 is preferred for technological control reasons, it will be appreciated that the use of pneumatic or mechanical devices of the conventional type for axially displacing the spindle sleeve 7 is not precluded and may alternatively be used. If the spindle sleeve 7 is hydraulically actuated, an electro-hydraulic control device of conventional type may be used in conjunction with an opto-electronic odometric system of like conventional type for controlling the axial displacement of the sleeve, so that the accuracy of adjustment of the sleeve, and hence of the tool spindle 8, is optimized.

The tool spindle 8 is rotatably mounted in the housing of the spindle sleeve 7 in two axially spaced apart ring shoulder extensions 7*b* and 7*c* which form a ring chamber, but is axially secured against axial displacement relative thereto. The tool spindle 8 serves to accommodate the machining tool or grinding tool such as a conventional cup-disc 9 and is driven by means of an electric motor 40 located in the ring chamber of the spindle sleeve housing and integral therewith, the armature 40*a* of which is mounted directly and non-rotatably fixedly on the tool spindle 8 itself, serving as motor shaft.

Figure 2:
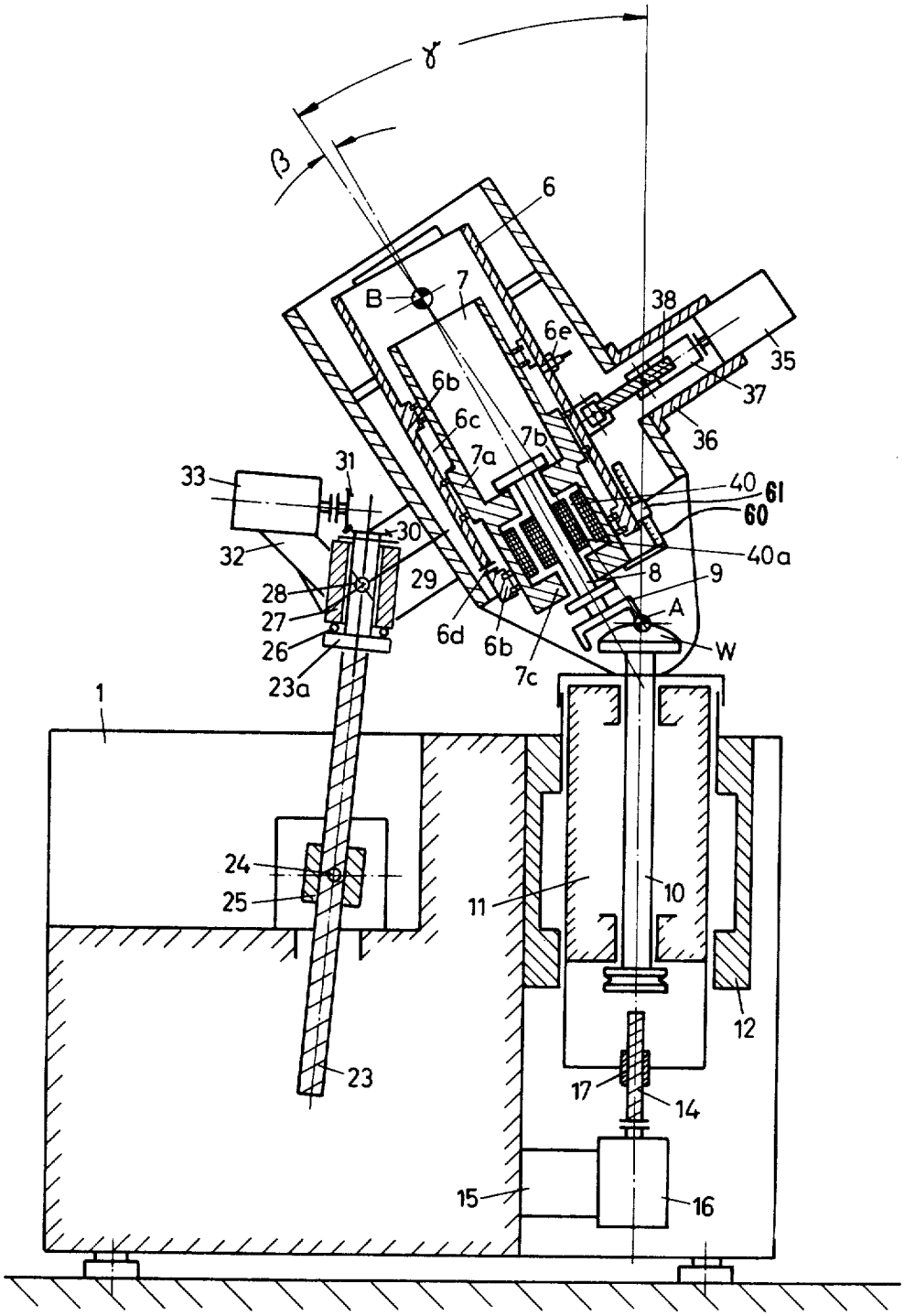
FIG. 2 is a schematic longitudinal section taken along the line I—I of FIG. 1.
Figure 2A:
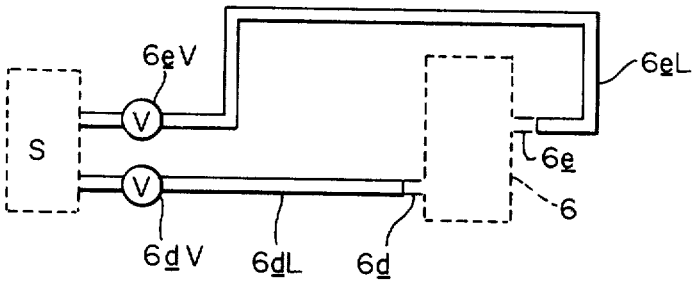
FIG. 2*a* is a schematic view showing supply and discharge pressure fluid medium valve locking means for a portion of the apparatus shown in FIG. 2.
Figure 2B:
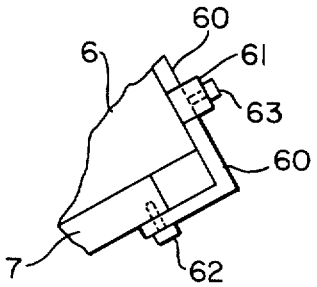
FIG. 2*b* is a schematic exaggerated view showing flange locking means in a portion of the apparatus shown in FIG. 2.

As can be seen in FIG. 2, the cup disc 9 is located on the outer end of the tool spindle 8. It is connected thereto, however, in such known manner as to be rotatably engaged. The tool spindle 8 has a cooperating workpiece spindle 10 angularly associated therewith but separate therefrom.

The workpiece spindle 10 is rotatably mounted in a block 11 within the machine frame 1 and is independently rotatable by means of an electric motor (not shown) in conventional manner. While the workpiece spindle 10 itself is prevented in conventional manner from axial displacement with respect to the block 11, the block is slidably mounted, for axial displacement in a guide 12 formed on the machine frame 1.

For adjusting the spindle 10 supporting the workpiece W into its position relative to the cup disc 9 necessary for the processing operation in the usual manner, the block 11 can be vertically reciprocated by the provision of a threaded spindle 14. This spindle 14 is driven by means of an electric motor 16 mounted on a stationary bracket 15 fixed on the frame 1. The motor 16 is controllable so as to execute a desired selective number or whole or partial revolutions in either direction of rotation by means of a conventional control device.

The threaded spindle 14 is guided in a spindle nut 17 at an angle of pitch which is so selected that when the spindle stops, the block 11, and hence the workpiece spindle 10 or the workpiece W, remain in the desired and adjusted linear spatial position with respect to the tilting or primary axis A of the swivel arm 2.

Figure 3:
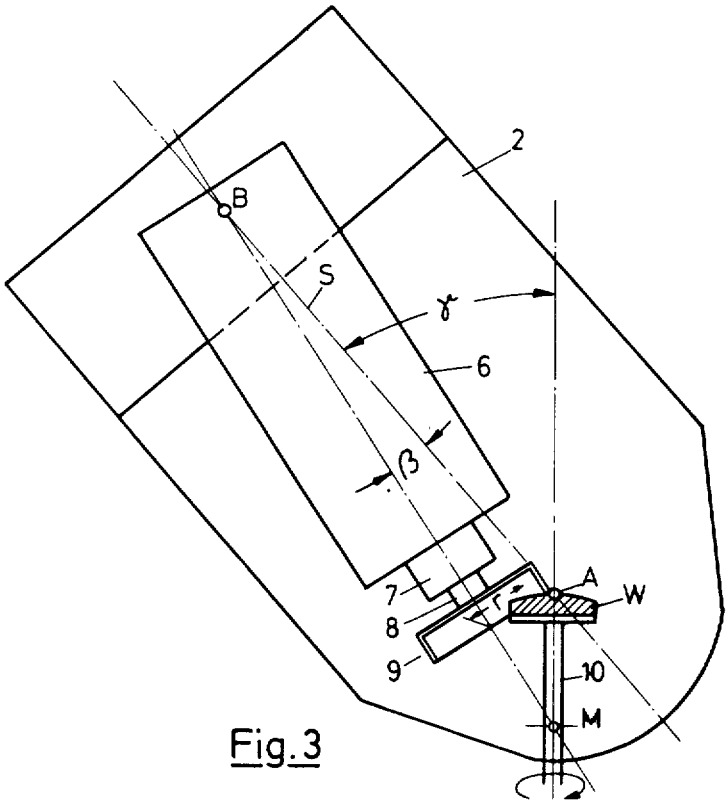
FIG. 3 shows, schematically, the basic geometric arrangement of a tool spindle holder forming part of the apparatus in accordance with the present invention suitable for producing a convex spherical surface.
Figure 4:
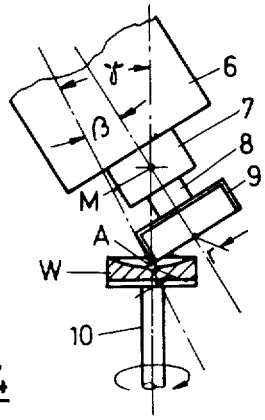
FIG. 4 is a schematic partial view of the corresponding geometric arrangement suitable for producing a concave spherical surface.

Both FIG. 3 and FIG. 4 of the drawing show that, regardless of whether a convex or a concave spherical surface is being produced, the ideal or primary axis A connecting the two pivot bearings 3 of the pivot head or swivel arm 2 is tangential to the apex or center point of such spherical surface. The radius of curvature of the spherical surface being produced depends in known manner upon the corresponding angle of inclination and the effective diameter of the grinding tool 9.

To permit the use of grinding tools or cup discs 9 of different sizes while still insuring that the cutting lip of the grinding tool 9 coincides with the axis of rotation of the workpiece spindle 10 and is accurately at or in the apex of the spherical surface to be produced, the rocker arm 6 is mounted so as to be pivotable about the seconary axis B and, by means of a conventional device not shown, is fixedly securable relative to the swivel arm 2.

For this purpose, the rocker arm 6 assumes an angular adjustment position relative to the swivel arm 2, such angle being designated $\beta$ (beta). The radius r of the grinding tool 9 is calculated from the sine of this angle $\beta$ or, alternatively, the angle $\beta$ can be determined from the radius r of the tool 9, depending upon which parameter is known, as the artisan will appreciate.

The arrangement of the usual, e.g. L-shaped stop or flange, type adjustable clamping device for the rocker arm 6 is expediently chosen so that it axially adjustably engages a point of the rocker arm 6 which is as far as possible from the pivot axis B for maximum leverage. This, in practice, is at a point which is as close as possible to the axial displacement point at which the axially displaceable spindle sleeve leaves the rocker arm (see FIGS. 1 and 2). This permits a rigid and reliable clamping of the rocker arm 6 relative to the swivel arm 2 to be attained with relatively small clamping forces.

In FIG. 3 of the drawing, there is also shown a point M at which the extension of the inclined axis of rotation of the tool spindle 8 and the substantially vertical axis of rotation of the workpiece spindle 10 intersect. This point is identical or coincident with the radially central point of the spherical surface of the workpiece W to be machined.

If the workpiece being machined is to have a convex spherical surface, the point of intersection M, as shown in FIG. 3, is always located below the primary axis A, which latter is tangential to the apex or center point of the spherical surface of the workpiece.

However, if a workpiece is to be provided with a concave spherical surface, such as the corresponding workpiece W' in FIG. 4, the intersection point M is located above the primary axis A. As shown in FIG. 4, in which like parts to those shown in FIG. 3 have been given the same reference numerals, the angle of inclination of the swivel arm 2 is denoted by $\gamma$ (gamma) and the relative angular disposition of the spindle sleeve 7 relative to the swivel arm 2 (taking into account the diameter of the grinding tool) is denoted by $\beta$.

For supporting the swivel arm 2 relative to the machine frame 1 and for adjusting the angle of inclination $\gamma$ of the swivel arm 2, a threaded spindle 23, preferably in the form of a rotary ball spindle of kown type is provided. This spindle 23 is displaceably mounted in a spindle nut 25 pivotably mounted on a journal 24 provided fixedly on the machine frame 1.

At its end facing the swivel arm 2, the threaded spindle 23 has a cylindrical collar portion 23*a* on which a bearing bush 27 abuts through the intermediary of an axial thrust bearing 26. This provides additional guidance for the threaded spindle. The bush 27 is, in turn, provided with hinge pins 28 on both of its sides which pivotally engage in receiving bores, which engage in two support arms 29 which are fixedly mounted on the swivel arm 2 and extend beyond the bush on both sides.

The threaded spindle 23 is axially secured relative to the bearing bush 27 and is driven through a bevel gear drive 30, 31 by an electric motor 33, fixedly stationarily mounted, by means of a support 32, on the pivotable bearing bush 27. A control device of the usual type (not shown), which is preferably actuated by an independent push-button in conventional manner, is provided to cause the electric motor 33 to rotate selectively in the required direction of the rotation.

Accordingly, the swivel arm 2, due to the influence of the threaded spindle 23, executes a tilting or angular movement about the primary axis A in one direction or the other so as to reduce or increase the corresponding angle of inclination $\gamma$ when the spindle 23 is at rest or initial reference position, but then reliably and accurately maintains the relative angular position thereof when at rest with respect to the workpiece spindle 10.

The angular adjustment of the rocker arm 6 relative to the swivel arm 2, is also attained by means of a drive exhibiting a self-locking effect, as can be seen from FIG. 2. Such drive comprises an electric motor 35 which, by means of a tubular adaptor member 36 provided with a securing flange, is fixedly stationarily secured to the swivel arm 2.

Connected by means of a gimbal to the drive shaft of the electric motor 35 is a spindle nut 37 which engages with a threaded take-up spindle 38 also preferably formed as a rotary ball spindle of known type. The threaded spindle 38 is pivotably connected to the spindle sleeve or hollow rocker arm 6.

By means of a control device (not shown), the electric motor 35 which may be a stepping or stepped motor, is caused to execute selective rotary movement in the desired direction of rotation, such rotation causing a reduction or extension of the adjusting composite spindle comprising the two parts 37 and 38. With a change of length in the adjusting composite spindle 37, 38, the angle $\beta$, taking into account the diameter of the tool, also changes in a direction depending upon the direction of rotation of the electric motor 35.

It will be appreciated that the parts associated with the spindle 14 and spindle nut 17 serve to lock inherently the workpiece spindle in any precise adjustable position of axial displacement so as to align precisely the stationary primary axis A with the apex of the spherical surface of the workpiece.

Likewise, the parts associated with spindle 23 and bush 27, including hinge pins 28 on bush 27 and support arms 29 on swivel arm 2, serve to lock inherently the swivel arm 2 in any precise adjustable position of angular displacement about primary axis A so as to align preliminarily the fixed distance line joining the primary and secondary axes A and B, and in turn, the rotating axis of the tool spindle 8 and cup disc 9, at a preliminary or initial selective angle to the rotational axis of the workpiece spindle 10.

In the same way, the parts associated with the spindle 38 and spindle nut 37 pivotally connected to the rocker arm 6 remote from the secondary axis B serve to lock inherently the rocker arm 6 in any precise adjustable position of angular displacement about secondary axis B for angular deviation from the line joining the primary and secondary axes A and B in dependence upon the effective diameter of the particular machinery tool or cup disc 9 selected so as to align finally and precisely accurately the angular operative position of such machinery tool or cup disc with respect to the apex of the spherical surface to be produced in the workpiece W and in turn with the tangent position of the primary axis A thereat.

This of course presupposes the conjoint axial alignment of the spindle sleeve 7 and in turn of the tool spindle 8 carrying the machine tool or cup disc 9 to project the cutting edge of such tool or cup disc 9 toward the workpiece spindle rotational axis so as to coincide with such apex of the spherical surface and the tangent position of the primary axis A thereat at the given position of angular deviation of the rocker arm 6 relative to the line joining the primary and secondary axes A and B.

Accordingly, the spindle sleeve 7 telescopingly arranged, e.g. concentrically, within hollow housing rocking arm 6, by reason of the end limiting internal axially opposed shoulder portions **6*b* in the interior of the rocker arm 6 and the intermediate external shoulder 7*a* on the exterior of the spindle sleeve 7, thereby defining a double acting cylinder space 6*c* therebetween having corresponding axially opposed alternate supply and discharge openings 6*d* and 6*e* from and to a pressure fluid medium source, is provided with locking means serving to lock inherently the spindle sleeve 7 and in turn the tool spindle 8 and its machining tool or cup disc 9 in any precise adjustable position of axial displacement with respect to the rocker arm 6. This in turn serves to maintain the cutting edge of such tool or cup disc 9 at the desired final and precisely accurate axial position along the rotational axis of the tool spindle 8 for concordant final and precise accurate angular adjustment of the tool spindle and cutting edge of the tool or cup disc 9** about secondary axis B for the stated conjoint alignment purposes relative to the apex of the spherical surface to be produced in the workpiece.

It will be appreciated that the use of conventional valves will inherently prevent any undesired supply or discharge of such pressure fluid medium relative to the double acting cylinder space **6*c*, and thus will inherently lock the spindle sleeve 7 against axial displacement with respect to rocker arm 6 except when such valve means are opened for double acting piston-cylinder operation of the spindle sleeve 7 within the rocker arm 6** in the usual manner.

The inwardly facing surfaces of supports 4 of the frame 1 may be conveniently used as angular indicator accommodating means. By providing a scale or other indicia of angular increments deviating from the plane passing through the primary axis A and coincident with the rotational axis of the workpiece spindle 10, on one such inwardly facing surface of a support 4 and a corresponding pointer in operative association therewith on swivel arm 2, the angle of inclination of swivel arm 2, measured between the line joining the primary and secondary axes A and B and the vertical plane passing through the rotational axis of the workpiece spindle 10, may be efficiently indicated in conventional manner as the artisan will appreciate.

Of course, other known angular indicator means may be accommodated on the machine frame 1 as noted above such as optical and/or electronic devices, e.g. including a rotary angle transmitter.

Besides hydraulic actuating means for the double acting piston-cylinder arrangement for achieving axial displacement of the spindle sleeve 7 relative to the rocker arm 6, it will be appreciated that other pressure fluid means may be employed such as pneumatic actuating means, or even electromechanical means such as a threaded spindle and spindle nut cooperating system akin to that used to effect axial displacement of workpiece spindle 10 relative to the machine frame 1 and in turn to the primary axis A.

In this regard, a similar scale of linear increments may be accommodated on the upper end portion of rocker arm 6 and a corresponding pointer in operative association therewith on the upper end portion of spindle sleeve 7 for indicating the distance of axial displacement of the spindle sleeve and in turn the tool spindle 8 relative to the rocker arm. Likewise, such a scale may be accommodated on the machine frame 1 and a corresponding pointer in operative association therewith on the upper end of block 11 for indicating the distance of axial displacement of the workpiece spindle 10 relative to the machine frame 1.

Moreover, a similar scale of angular increments deviating from the line joining the primary and secondary axes A and B may be accommodated at the upper end portion of the swivel arm 2 and a corresponding pointer in operative association therewith on the upper end portion of the rocker arm 6, whereby to indicate such angle of deviation of the tool spindle 8 and in turn the cutting edge of the machining tool or cup disc 9 with respect to the line joining such primary and secondary axes A and B.

Nevertheless, as noted above, other known indicating means may be accommodated on the machine frame 1 for the various desired purposes such as electro-hydraulic control devices, e.g. in conjunction with opto-electronic odometric systems and devices for indicating the distance moved by each of the corresponding axially and/or angularly displaceable parts as the case may be for ultimately controlling the corresponding setting and adjustment movements of the spindle sleeve 7 and in turn of the tool spindle 8 and cutting edge of the machining tool or cup disc 9 relative to the primary axis A and in turn the apex of the spherical surface to be produced.

Accordingly, the present invention contemplates an apparatus for producing convex and/or concave spherical surfaces in workpieces such as optical lenses, comprising a frame, a workpiece spindle selectively mounted relative to the frame and having an end face to which is securable a workpiece to be machined to provide a spherical surface of selective radius and having a corresponding apex, a tool spindle selectively mounted on the frame and carrying a machining tool of correspondingly selective effective diameter relative to the selective radius of the spherical surface of the workpiece for machining the workpiece, the two spindles being disposed for corresponding, e.g. independent, rotation at a pre-selective angle to one another, and angular positioning means.

The angular positioning means include two mutually adjustable members for retaining the tool spindle in its corresponding angular position relative to the workpiece spindle in conformity with such pre-selective angle between the two spindles.

The first of said members is mounted for pivoting about a stationary proximate primary pivotal axis which is tangential to the apex of the spherical surface to be produced, and such member has a selective effective longitudinal dimension extending remotely from the primary axis. The first member is also adjustably locatable at a pre-selected angle of inclination initially generally or preliminarily corresponding to such pre-selective angle between the two spindles in dependence upon the selective radius of the spherical surface to the machined.

The second of said members has the tool spindle directly mounted for rotation thereon and is itself mounted for pivoting about a movable or floating distal secondary pivotal axis on the first member, the pivotal axes of mounting of the two members extending substantially parallel to one another and being spaced apart by a distance corresponding substantially to the effective longitudinal dimension of the first member. The second member which is pivotable about the secondary axis is advantageously locatable at an angular position with respect to a line joining the two axes, which angular position is selected in dependence upon the effective diameter of the machining tool for final accurate angular alignment thereof with respect to the apex of the spherical surface to be produced.

Preferably, the first member is in the form of a swivel arm having a pivot mounting end at which such proximate primary axis is located and a free end in opposed axial relation thereto, and the second member is mounted on the first member and is in the form of a rocker arm, and a spindle sleeve is provided in the rocker arm which receives the tool spindle and which is selectively axially displaceably mounted in the rocker arm for extending therebeyond for adjusting the locating of the machining tool relative to the primary axis and apex of the spherical surface to be produced.

Advantageously, the pivotal mounting of the rocker arm about the secondary axis is on the free end of the swivel arm.

Angular indicator accommodating means are conveniently provided for accommodating an angle indicator for indicating the angle of adjustment of the swivel arm with respect to its initial reference position relative to the work piece spindle.

Axial displacement actuating means, preferably pressure fluid medium actuatable actuating means, are also favorably provided for axially displacing the spindle sleeve relative to the rocker arm.

Moreover, linear indicator accommodating means are conveniently provided for accommodating a linear distance indicator for indicating the distance of axial displacement of the spindle sleeve for controlling the corresponding setting and adjustment movements of the spindle sleeve and in turn of the tool spindle.

A high frequency motor is desirably provided in the spindle sleeve for rotating the tool spindle. Such motor favorably contains a stator portion mounted in the spindle sleeve and a rotor portion mounted on and operatively integral with the tool spindle.

Furthermore, mechanically actuated angular adjustment means are preferably provided for individually adjusting the corresponding angular position of the swivel arm and rocker arm, and such swivel arm may be conveniently provided in the form of a gantry.

Stated otherwise, the present invention concerns basically an apparatus for producing spherical surfaces in work pieces such as optical lenses, comprising a frame, a first member mounted on the frame for pivoting about a primary pivotal axis, said first member having a selective effective longitudinal dimension extending from the primary axis, a second member mounted on the first member for pivoting about a secondary pivotal axis parallel to and spaced from the primary axis a distance corresponding to the effective longitudinal dimension of the first member and which distance is defined by a line joining the primary and secondary axes, a tool spindle mounted on the second member for rotation about a tool rotation axis which is angularly adjustable relative to the line joining the primary and secondary axes about the secondary axis, said tool spindle carrying a machine tool of selective effective diameter, and a workpiece spindle.

The workpiece spindle is selectively adjustably mounted relative to the frame and in turn relative to the primary axis for rotation about a workpiece rotation axis, e.g. normal to and, intersecting the primary axis and is correspondingly disposed at an angle to the tool axis and to the line joining the primary and secondary axes, and is adapted to secure thereon a workpiece to be machined to provide a workpiece spherical surface of correspondingly selective radius relative to the selective effective diameter of the machining tool and a corresponding workpiece spherical surface apex.

The workpiece spindle is adjustable to align the primary axis therewith so as to be tangential to the apex of the spherical surface to be produced, and the tool spindle is locatable at an angular position with respect to the line joining the primary and secondary axes, which angular position is selected in dependence upon the effective diameter of the machining tool for final accurate angular alignment thereof with respect to the apex of the spherical surface to be produced.

Advantageously, a spindle sleeve is provided in the second member which receives the tool spindle and which is selectively axially displaceably mounted in the second member for adjusting the location of the machining tool, i.e. in cooperative conjunction with the angular adjustment of the tool spindle, relative to the primary axis and the apex of the spherical surface to be produced.

Preferably, the spindle sleeve is axially displaceably mounted in the second member for extending beyond the second member in the direction of the workpiece spindle.

Furthermore, suitable axial displacement actuating means are provided for axially displacing the spindle sleeve relative to the second member. Also, a motor may be desirably provided for rotating the tool spindle including a stator field portion in the spindle sleeve and a rotor armature portion mounted on and operatively fixedly integral with the tool spindle for common rotation therewith as the shaft of such motor.

Additionally, angular adjustment means are favorably provided for individually adjusting the corresponding angular position of the first member relative to the workpiece axis and of the second member relative to the line joining the primary and secondary axes.

The foregoing constructional aspects of the present invention accordingly provide for producing polishable spherical surfaces in workpieces such as optical lenses, advantageously in a single operation while avoiding the use of radially fixed tools, and contemplating an apparatus which is structurally sound, readily monitorable and simple to operate at minimum cost.

It will be appreciated that the foregong specification and accompanying drawings are set forth by way of illustration and not limitation of the present invention, and that various modifications and changes may be made therein without departing from the spirit and scope of the present invention which is to be limited solely by the scope of the appended claims.

What is claimed is:

1. Apparatus for producing convex and/or concave spherical surfaces in workpieces such as optical lenses, comprising a frame, a workpiece spindle selectively mounted relative to the frame and having an end face to which is securable a workpiece to be machined to provide a spherical surface of selective radius and having a corresponding apex, a tool spindle selectively mounted on the frame and carrying a machining tool of correspondingly selective effective diameter relative to the selective radius of the spherical surface of the workpiece for machining the workpiece, the two spindles being disposed for corresponding rotation at a pre-selective angle to one another, and angular positioning means including two mutually adjustable members for retaining the tool spindle in its corresponding angular position relative to the workpiece spindle in conformity with such pre-selective angle between the two spindles, the first of said members being mounted for pivoting about a primary pivotal axis which is tangential to the apex of the spherical surface to be produced, and having a selective effective longitudinal dimension extending from the primary axis, such first member being adjustably locatable at a pre-selected angle of inclination initially generally corresponding to such pre-selective angle between the two spindles in dependence upon the selective radius of the spherical surface to be machined, the second of said members having the tool spindle directly mounted for rotation thereon and being mounted for pivoting about a secondary pivotal axis on the first member, the pivotal axes of mounting of the two members extending substantially parallel to one another and being spaced apart by a distance corresponding substantially to the effective longitudinal dimension of the first member, the second member which is pivotable about the secondary axis being locatable at an angular position with respect to a line joining the two axes, which angular position is selected in dependence upon the effective diameter of the machining tool for final accurate angular alignment thereof with respect to the apex of the spherical surface to be produced, and the first member being in the form of a swivel arm having a pivot mounting end at which such primary axis is located and a free end in opposed relation thereto, and the second member being mounted on the first member and being in the form of a rocker arm, and a spindle sleeve being provided in the rocker arm which receives the tool spindle and which is selectively axially displaceably mounted in the rocker arm for extending therebeyond for adjusting the location of the machining tool relative to the primary axis and apex of the spherical surface to be produced.

2. Apparatus according to claim 1 wherein the pivotal mounting of the rocker arm about the secondary axis is on the free end of the swivel arm.

3. Apparatus according to claim 2 wherein angular indicator accommodating means are provided for accommodating an angle indicator for indicating the angle of adjustment of the swivel arm with respect to its initial reference position relative to the workpiece spindle.

4. Apparatus according to claim 2 wherein axial displacement actuating means are provided for axially displacing the spindle sleeve relative to the rocker arm.

5. Apparatus according to claim 4 wherein the actuating means are pressure fluid medium actuatable actuating means.

6. Apparatus according to claim 4 wherein linear indicator accommodating means are provided for accommodating a linear distance indicator for indicating the distance of axial displacement of the spindle sleeve for controlling the corresponding setting and adjustment movements of the spindle sleeve and in turn of the tool spindle.

7. Apparatus according to claim 1 wherein a high frequency motor is provided in the spindle sleeve for rotating the tool spindle.

8. Apparatus according to claim 7 wherein the motor contains a stator portion mounted in the spindle sleeve and a rotor portion mounted on and operatively integral with the tool spindle.

9. Apparatus according to claim 1 wherein mechanically actuated angular adjustment means are provided for individually adjusting the corresponding angular position of the swivel arm and rocker arm.

10. Apparatus according to claim 1 wherein the swivel arm is in the form of a gantry.

11. Apparatus for producing spherical surfaces in workpieces such as optical lenses, comprising a frame, a first member mounted on the frame for pivoting about a primary pivotal axis, a second member mounted on the first member for pivoting about a second pivotal axis parallel to and spaced from the primary axis a fixed distance which is defined by a line joining the primary and secondary axes, a tool spindle mounted on the second member for adjustable axial displacement relative thereto and also mounted thereon for rotation about a tool rotation axis which is angularly adjustable relative to the line joining the primary and secondary axes about the secondary axis, for carrying a machining tool of selective effective diameter, and a workpiece spindle selectively adjustably mounted relative to the frame and in turn relative to the primary axis for rotation about a workpiece rotation axis intersecting the primary axis and correspondingly disposed at an angle to the tool axis and to the line joining the primary and secondary axes, and being adapted to secure thereon a workpiece to be machined to provide a workpiece spherical surface of correspondingly selective radius relative to the selective effective diameter of the machining tool and a corresponding workpiece spherical surface apex, the workpiece spindle being adjustable to align the primary axis therewith so as to be tangential to the apex of the spherical surface to be produced, and the tool spindle being locatable at an angular position with respect to the line joining the primary and secondary axes which is selected in dependence upon the effective diameter of the machining tool for final accurate angular alignment thereof with respect to the apex of the spherical surface to be produced, and the tool spindle being axially displaceable for correspondingly adjusting the location of the machining tool relative to the primary axis and the apex of the spherical surface to be produced.

12. Apparatus for producing spherical surfaces in workpieces such as optical lenses, comprising a frame, a first member mounted on the frame for pivoting about a primary pivotal axis, a second member mounted on the first member for pivoting about a secondary pivotal axis parallel to and spaced from the primary axis a fixed distance which is defined by a line joining the primary and secondary axes, a tool spindle mounted on the second member for rotation about a tool rotation axis which is angularly adjustable relative to the line joining the primary and secondary axes about the secondary axis, for carrying a machining tool of selective effective diameter, and a workpiece spindle selectively adjustably mounted relative to the frame and in turn relative to the primary axis for rotation about a workpiece rotation axis intersecting the primary axis and correspondingly disposed at an angle to the tool axis and to the line joining the primary and secondary axes, and being adapted to secure thereon a workpiece to be machined to provide a workpiece spherical surface of correspondingly selective radius relative to the selective effective diameter of the machining tool and a corresponding workpiece spherical surface apex, the workpiece spindle being adjustable to align the primary axis therewith so as to be tangential to the apex of the spherical surface to be produced, the tool spindle being locatable at an angular position with respect to the line joining the primary and secondary axes which is selected in dependence upon the effective diameter of the machining tool for final accurate angular alignment thereof with respect to the apex of the spherical surface to be produced, said a spindle sleeve being provided in the second member which receives the tool spindle and which is selectively axially displaceably mounted in the second member for adjusting the location of the machining tool relative to the primary axis and the apex of the spherical surface to be produced.

13. Apparatus according to claim 12 wherein axial displacement actuating means are provided for axially displacing the spindle sleeve relative to the second member.

14. Apparatus according to claim 12 wherein a motor is provided for rotating the tool spindle including a stator portion in the spindle sleeve and a rotor portion mounted on and operatively integral with the tool spindle.

15. Apparatus according to claim 11 wherein angular adjustment means are provided for individually adjusting the corresponding angular position of the first member relative to the workpiece axis and of the second member relative to the line joining the primary and secondary axes.

16. Apparatus for producing convex and/or concave spherical surfaces in workpieces such as optical lenses, comprising a frame, a workpiece spindle selectively mounted relative to the frame and having an end face to which is securable a workpiece to be machined to provide a spherical surface of selective radius and having a corresponding apex, a tool spindle selectively mounted on the frame and carrying a machining tool of correspondingly selective effective diameter relative to the selective radius of the spherical surface of the workpiece for machining the workpiece, the two spindles being disposed for corresponding rotation at a pre-selective angle to one another, and angular positioning means including two mutually adjustable members for retaining the tool spindle in its corresponding angular position relative to the workpiece spindle in conformity with such pre-selective angle between the two spindles, the first of said members being mounted for pivoting about a primary pivotal axis which is tangential to the apex of the spherical surface to be produced, and having a selective effective longitudinal dimension extending from the primary axis, such first member being adjustably locatable at a pre-selected angle of inclination initially generally corresponding to such pre-selective angle between the two spindles in dependence upon the selective radius of the spherical surface to be machined, the second of said members having the tool spindle directly mounted for rotation thereof and for adjustable axial displacement relative thereto, the second member being mounted for pivoting about a secondary pivotal axis on the first member, the pivotal axes of mounting of the two members extending substantially parallel to one another and being spaced apart by a distance corresponding substantially to the effective longitudinal dimension of the first member, the second member which is pivotable about the secondary axis being locatable at an angular position with respect to a line joining the two axes, which angular position is selected in dependence upon the effective diameter of the machining tool for final accurate angular alignment thereof with respect to the apex of the spherical surface to be produced, and the tool spindle being axially displaceable for correspondingly adjusting the location of the machining tool relative to the primary axis and apex of the spherical surface to be produced.

* * * * *